Figure 1:
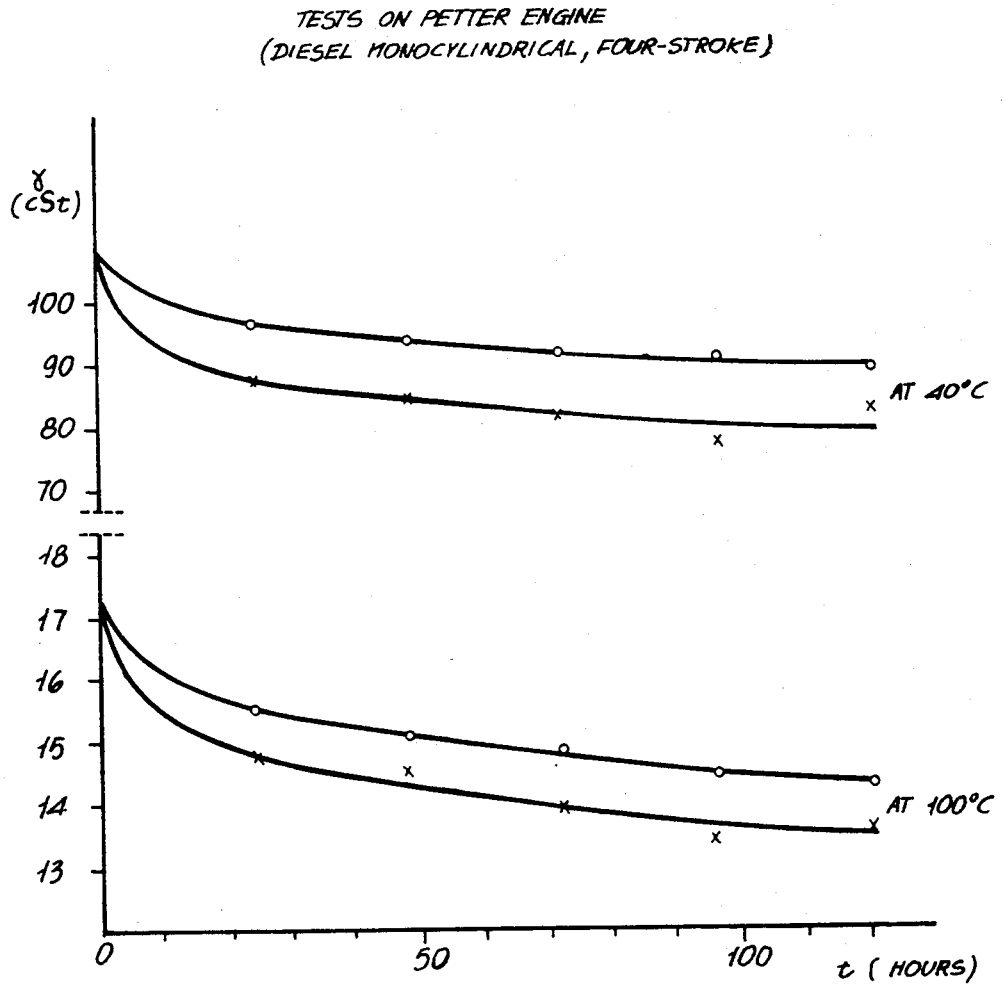

o OIL SAE 15W-50 BASED ON NT/50 S (EXAMPLE 3)

x OIL SAE 15W-50 BASED ON TRIMETHYLOLPROPANE-TRIPELARGONATE (EXAMPLE 4)

ESTERS OF POLYVALENT ALCOHOLS, PROCESS FOR PREPARING THEM AND THEIR USE AS LUBRICATING OILS

The present application is a continuation in part of the copending application No. 382,757 filed on May 27, 1982, abandoned which is a continuation of application No. 181,280 of the same Applicant, filed on Aug. 25, 1980 abandoned.

BACKGROUND OF THE INVENTION

The present invention refers to esters with a mixture of polyhydroxyl alcohols, hexahydrobenzoic acid and a linear carboxylic acid as new industrial products.

The present invention further refers to a process for the preparation of said esters, as well as to their use in the field of lubrication, hydraulic fluids, oily emulsion, and thermal fluids, and in particular to the so-called EP (extreme pressure) fluids.

The use of synthetic lubricants based on long chain, linear aliphatic esters of pelargonic acid, lauric acid, palmitic acid, etc., is known; however, since said acids are of natural origin, their price is relatively high and therefore the lubricating oils obtained therefrom can hardly compete with the mineral oils from oil from an economic viewpoint. Attemps have been also made to obviate this drawback by using e.g. benzoic acid esters which are much cheaper. These esters, however, have not been successful because of a number of drawbacks, such as e.g. that in combustion engines they form partially incombustible products, whereby they produce highly smoky products in the discharge gases. A further drawback is that the lubricating power and especially the viscoelasticity of benzoic acid based esters is relatively not good.

SUMMARY OF THE INVENTION

The Applicant has now surprisingly found a new class of esters, better to be specified hereinafter, of polyhydroxyl alcohols with a mixture of hexahydrobenzoic acid and a linear carboxylic acid, having characteristics of viscosity and stability such that they can be successfully employed in the field of lubricants, of hydraulic fluids, of oily emulsions, of thermal fluids, and particularly in the field of the so-called EP fluids and so on.

More particularly they can be successfully used in lubricating compositions having improved features regarding a high detergency and a lower loss of viscosity during prolonged use.

The new class of esters can be defined by the following general formula (A):

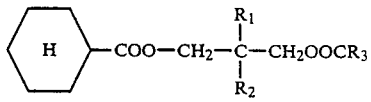

(A)

in which $R_1$ is an alkyl radical selected from the group consisting of methyl and ethyl; $R_2$ is an alkyl radical selected from the group consisting of methyl and ethyl; and $R_3$ is an alkyl radical having the formula $C_nH_{2n+1}$ wherein n is a number from 5 to 11.

Obviously n is not always a whole number but in some instances it can also be a decimal number, such as 8.33, 8.66, 10.33, 10.66 and so on.

Preferably $R_3$ is $—C_8H_{17}$ or $—C_{11}H_{23}$.

The present invention further relates to a process for the preparation of the esters of general formula (A). Said process is characterized by the fact that an alcohol of the formula

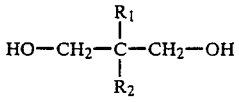

wherein $R_1$ and $R_2$ have the same meaning as given in the general formula (A), is reacted with a stoichiometric amount of an essentially equimolar mixture (B) consisting of hexahydrobenzoic acid and an acid of the formula $R_3$—COOH, wherein $R_3$ has the same meaning as defined in the general formula (A).

By essentially equimolar it is meant that from 0.95 to 1.05 moles of the linear acid ($R_3$—COOH) is used for each mole of the hexahydrobenzoic acid.

The preparation of these esters may be carried out by mixing the components and heating the mixture to the suitable temperature, in the presence or in the absence of an azeotropism agent in order to eliminate more easily and continuously the water which is produced in the reaction.

When toluene is used as an agent for promoting the separation of the water from the system, it is necessary to employ such an amount as is sufficient to maintain the reaction temperature at the desired value. E.g., to maintain a temperature of 200° C., from 10 to 100 g of toluene should be used per 1 kg of reaction mass (acids plus alcohol).

It is possible, as already mentioned, to employ a slight excess of one of the components of the acid mixture with respect to the theoretical value calculated from the number of the OH groups in the alcohol or mixture of alcohols. In general, it is convenient to use a slight excess of the linear acid with respect to the hexahydrobenzoic acid.

The esterification may be carried out discontinuously or continuously, in the presence or in the absence of the conventional esterification catalysts.

The reaction times suitably vary from 5 to 50 hours, depending on whether a catalyst is used.

Of course when no catalysts are used, it is convenient, because of the longer reaction times, to operate discontinuously, while when catalysts, such as sulphuric or phosphoric acid, are used, it is convenient to operate continuously.

Hereinafter a way of preparing the esters of formula (A) will be described, which obviously is to be considered as illustrative and not limitative.

The reaction mixture containing the alcohol and both the linear as well as the hexahydrobenzoic acid in essentially equimolar amounts, is conveniently heated to 195° C., and said temperature is maintained for a period from 2 to 8 hours, whereafter the toluene is added in an amount from 0.1 to 1.0% by weight with respect to the reaction mass, and the heating is then continued until the discharge of water comes to an end. The excess of carboxylic acid and azeotropism agent, if any, may be removed under a vacuum.

The present invention relates also to the use of at least one of the esters of general formula (A) in the field of lubrication, hydraulic fluids, oily emulsions, thermal fluids, EP fluids and the like. By the use of such esters as lubricants, the main disadvantages and/or drawback -continued

| | Before the test | After the test |
|---|---|---|
| | | hours) |
| kinematic viscosity at 100° C. (ASTM D 445) | 17.2 | 14.3 |
| kinematic viscosity at 40° C. (ASTM D 445) | 108.8 | 88.9 |
| dynamic viscosity at −18° C. (calculated) | 4000 | 2980 |
| viscosity index (ASTM D 2270) | 171 | 164 |
| flash point (OC), °C. (ASTM D 92) | 225° | 220° |
| density at 18° C. | 0.90 | 0.90 |
| volatility at 250°, NOACK (DIN 51581), % | 8.1 | 8.5 (96 hours) |
| Content in Fe (ppm) | 3.2 | 39.7 |
| Content in Cr (ppm) | 0.2 | 0.2 |
| Content in Mn (ppm) | 0.2 | 0.5 |
| Content in Cu (ppm) | 0.9 | 9.8 |
| Content in Pb (ppm) | 1.7 | 5.6 |
| Content in Al (ppm) | 1.0 | 1.0 |

The viscosity changes during prolonged use as indicated in FIG. 1.

EXAMPLE 4

A lubricating oil, prepared with 63.4% (by weight) of mineral bases SN and 20% of trimethylolpropane tripelargonate, and therefore not containing any of the esters of the general formula (A), the amount to 100 being constituted by the packet of additives for gasoline engine oil, and by the viscosity index improver, has been submitted to a discontinue working test (cycles of about 12 hours) for 120 total hours on a Petter engine (Diesel, monocylindrical, four-stroke) using as fuel a gas oil with high sulphur content (about 2%).

The chemical-physical characteristics of the oil, before and after the test are reported in the table:

| | Before the test | After the test |
|---|---|---|
| | | (120 hours) |
| kinematic viscosity at 100° C. (ASTM D 445) | 17.3 | 13.5 |
| kinematic viscosity at 40° C. (ASTM D 445) | 108.2 | 82.2 |
| dinamic viscosity at −18° C. (calcolated) | 3450 | 2760 |
| viscosity index (ASTM D 2270) | 172 | 164 |
| flash point (OC), °C. (ASTM D 92) | 227 | 225 |
| density at 18° C. | 0.90 | 0.90 |
| volatility at 250°, NOACK (DIN 51581), % | 6.4 | 7.7 (96 hours) |
| Content in Fe (ppm) | 5.2 | 43.5 |
| Content in Cr (ppm) | 0.2 | 0.2 |
| Content in Mn (ppm) | 0.4 | 0.7 |
| Content in Cu (ppm) | 1.4 | 10.7 |
| Content in Pb (ppm) | 1.9 | 5.9 |
| Content in Al (ppm) | 1.0 | 1.0 |

The viscosity changes during prolonged use as indicated in FIG. 1.

EXAMPLE 5

(comparative example with example 1)

Example 1 is repeated using a molar ratio of hexahydrobenzoic acid:lauric acid equal to 0.45:0.55.

The average chemical-physical characteristics of the obtained products are the following:

| | |
|---|---|
| kinematic viscosity at 100° C. (ASTM D 445), cSt | 4.0 |
| viscosity index (ASTM D 2270) | 125 |
| pour point, °C. (ASTM D 97) | 0 |
| NOACK | 14.5 |

EXAMPLE 6

(comparative example with example 1)

Example 1 is repeated using a molar ratio of hexahydrobenzoic acid:lauric acid equal to 0.55:0.45.

The average chemical-physical characteristics of the obtained product are the following:

| | |
|---|---|
| kinematic viscosity at 100° C. (ASTM D 445.), cSt | 3.9 |
| viscosity index (ASTM D 2270) | 140 |
| pour point, °C. (ASTM D 97) | −5 |
| NOACK | 12.5 |

As the two comparison examples 5 and 6 clearly show by not keeping the molar ratio of 0.5, the pour point characteristic is worse.

EXAMPLE 7

(comparative example with example 2)

Example 5 is repeated substituting lauric acid with pelargonic acid. pelargonic acid.

The average chemical-physical characteristics of the obtained product are the following:

| | |
|---|---|
| kinematic viscosity at 100° C. (ASTM D 445), cSt | 3.4 |
| viscosity index (ASTM D 2270) | 100 |
| Pour point, °C. (ASTM D 97) | −40 |
| NOACK | 25 |

EXAMPLE 8

(comparative example with example 2)

Example 6 is repeated substituting lauric acid with pelargonic acid.

The average chemical-physical characteristics of the obtained product are the following:

| | |
|---|---|
| kinematic viscosity at 100° C. (ASTM D 445), cSt | 3.1 |
| viscosity index (ASTM D 2270) | 118 |
| pour point, °C. (ASTM D 97) | −45 |
| NOACK | 28 |

Also these comparison Examples 7 and 8 clearly show that the characteristic which decreases in an essential way in respect with the examples 1 and 2 is the pour point.

We claim:

1. An ester of the general formula (A)

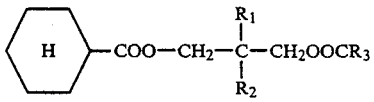

(A)

in which $R_1$ is an alkyl radical selected from the group consisting of methyl and ethyl;

$R_2$ is an alkyl radical selected from the group consisting of methyl and ethyl; and $R_3$ is an alkyl radical having the formula $C_nH_{2n+1}$ wherein n is a number from 5 to 11.

2. An ester having the formula

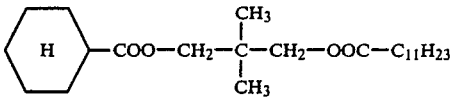

3. An ester having the formula

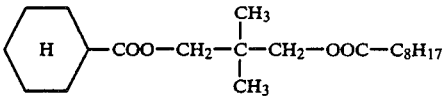

4. A process for the preparation of an ester of the general formula (A) as defined in claim 1, said process comprising reacting, by heating at a temperature up to 200° C. sufficient to cause esterification, for a duration of from 5 to 50 hours, an alcohol of the formula

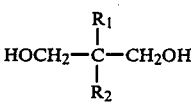

wherein $R_1$ and $R_2$ have the same meaning as given in claim 1, with a stoichiometric amount of an essentially equimolar mixture (B) consisting of hexahydrobenzoic acid and an acid of formula $R_3$—COOH wherein $R_3$ has the same meaning as given in claim 1.

5. A process according to claim 4 wherein the mixture (B) contains from 0.95 to 1.05 moles of $R_3$—COOH for each mole of hexahydrobenzoic acid.

6. A base for lubricating oils, said base comprising at least one ester of the general formula (A)

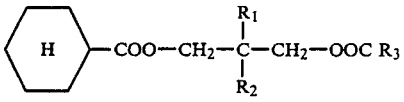

in which $R_1$ is an alkyl radical selected from the group consisting of methyl and ethyl;

$R_2$ is an alkyl radical selected from the group consisting of methyl and ethyl; and $R_3$ is an alkyl radical having the formula $C_nH_{2n+1}$ wherein n is a number from 5 to 11.

7. A base for lubricating oils, said base comprising an ester of the formula

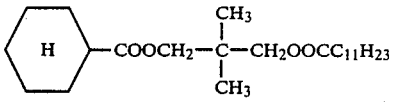

8. A base for lubricating oils, said base comprising an ester of the formula

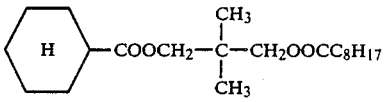

9. A base for lubricating oils according to claim 6, additionally containing other lubricating oils.

10. A base for lubricating oils according to claim 6, additionally containing at least one normal, viscosity index improving additive, detergent, dispersing and/or antifoaming additive.

11. A base for lubricating oils according to claim 9, additionally containing at least one normal, viscosity index improving additive, detergent, dispersing and/or antifoaming additive.

* * * * *

United States Patent [19]

Piel et al.

[11] Patent Number: 4,491,529

[45] Date of Patent: Jan. 1, 1985

[54] HEAT ACCUMULATING AGENT

[75] Inventors: Vera Piel; Johann Schröder, both of Aachen, Fed. Rep. of Germany

[73] Assignee: U.S. Philips Corporation, New York, N.Y.

[21] Appl. No.: 518,274

[22] Filed: Jul. 28, 1983

[30] Foreign Application Priority Data

Nov. 5, 1982 [DE] Fed. Rep. of Germany ..... 3240855

[51] Int. Cl.[3] ..... C09K 5/06

[52] U.S. Cl. ..... 252/70; 423/266; 423/497

[58] Field of Search ..... 252/70; 423/266, 497

[56] References Cited

FOREIGN PATENT DOCUMENTS

| | | | |
|---|---|---|---|
| 55-45730 | 3/1980 | Japan | 252/70 |
| 57-151675 | 9/1982 | Japan | 252/70 |
| 2001096 | 1/1979 | United Kingdom | 252/70 |

*Primary Examiner*—Paul Lieberman
*Assistant Examiner*—Robert A. Wax
*Attorney, Agent, or Firm*—Norman N. Spain

[57] ABSTRACT

The use of calcium chloride hexahydrate as a heat accumulating agent for latent heat accumulators is improved when as a nucleating agent (so as to avoid supercooling) special caesium salts, bismuth salts and/or lead salts are used.

10 Claims, No Drawings